US005590593A

United States Patent [19]

Korhonen et al.

[11] Patent Number: 5,590,593

[45] Date of Patent: Jan. 7, 1997

[54] MOUNTING ARRANGEMENT FOR CALENDAR ROLLS IN A CALENDER

[75] Inventors: Ville Korhonen, Jyväskylä ; Timo Pirinen, Palokka; Jorma Ramstedt, Vaajakoski, all of Finland

[73] Assignee: Valmet Corporation, Helsinki, Finland

[21] Appl. No.: 364,120

[22] Filed: Dec. 27, 1994

[30] Foreign Application Priority Data

Dec. 29, 1993 [FI] Finland ..... 935912

[51] Int. Cl.[6] ..... D21G 1/00; B30B 3/04

[52] U.S. Cl. ..... 100/93 RP; 100/162 B; 100/163 A; 100/170

[58] Field of Search ..... 100/93 RP, 161–165, 100/170, 172

[56] References Cited

U.S. PATENT DOCUMENTS

| | | | |
|---|---|---|---|
| 3,884,140 | 5/1975 | Christ et al. . | |
| 3,884,141 | 5/1975 | Lehmann | 100/163 R |
| 4,319,522 | 3/1982 | Marchioro et al. | 100/123 B |
| 4,389,932 | 6/1983 | Pav | 100/162 B |
| 4,498,383 | 2/1985 | Pav et al. | 100/162 B |
| 4,597,275 | 7/1986 | Schneid et al. | 72/21 |
| 4,606,264 | 8/1986 | Agronin et al. | 100/38 |
| 4,614,565 | 9/1986 | Riihinen | 100/93 RP |
| 4,653,395 | 3/1987 | Verkasalo | 100/38 |
| 4,903,517 | 2/1990 | Van Haag et al. | 72/245 |
| 4,960,046 | 10/1990 | Anstöltz et al. | 100/93 RP |
| 5,029,521 | 7/1991 | Pav et al. | 100/163 R |
| 5,137,678 | 8/1992 | Hess et al. | 264/280 |
| 5,144,890 | 9/1992 | Korhonen | 100/163 A |

FOREIGN PATENT DOCUMENTS

| | | | |
|---|---|---|---|
| 369063 | 12/1982 | Austria . | |
| 0328502 | 8/1989 | European Pat. Off. . | |
| 0332594 | 9/1989 | European Pat. Off. . | |
| 0425138 | 5/1991 | European Pat. Off. . | |
| 56870 | 10/1974 | Finland . | |
| 55373 | 10/1974 | Finland . | |
| 79875 | 4/1985 | Finland . | |
| 71374 | 7/1986 | Finland . | |
| 74066 | 7/1986 | Finland . | |
| 79178 | 2/1988 | Finland . | |
| 79177 | 2/1988 | Finland . | |
| 89525 | 11/1988 | Finland . | |
| 892935 | 12/1989 | Finland . | |
| 911668 | 10/1991 | Finland . | |
| 2504149 | 7/1976 | Germany . | |
| 2909277 | 9/1980 | Germany . | |
| 2049516 | 12/1980 | United Kingdom . | |
| 2119422 | 11/1983 | United Kingdom | 100/162 R |

OTHER PUBLICATIONS

"Control of a Deckling Calender", J. A. Picard and D. A. D'Amato, Tappi Journal, vol. 66, No. 2, Feb. 1983, pp. 81–84.

*Primary Examiner*—Stephen F. Gerrity
*Attorney, Agent, or Firm*—Steinberg, Raskin & Davidson, P.C.

[57] ABSTRACT

A calender for a web including a calender frame and a stack of rolls mounted on the frame and consisting of four rolls arranged one above the other. In the stack, adjacent rolls placed one above the other are arrangeable in nip-defining relationship with one another so as to calender the web in the nips. The stack of rolls in the calender is composed of three variable-crown rolls, of which rolls the roll mantle of at least one roll is displaceable in relation to its roll axle in the direction of the nip plane by loading devices arranged inside the roll, and one heatable roll arranged between two variable-crown rolls. The rolls are preferably arranged vertically so that the two lowest rolls and the uppermost roll are variable-crown rolls and that the third roll from the bottom of the stack is a heatable roll.

17 Claims, 3 Drawing Sheets

MOUNTING ARRANGEMENT FOR CALENDAR ROLLS IN A CALENDER

BACKGROUND OF THE INVENTION

The present invention relates to a calender, comprising a calender frame and a stack of at least four rolls mounted on the frame and consisting of four rolls arranged vertically one above the other. In the stack, each roll placed one above the other can be situated in nip contact, i.e., nip-defining relationship, with an adjacent roll so as to calender the paper web or equivalent in the nips thus formed.

Strict requirements are imposed on a modern calender vis-a-vis loading capacity and mode of calendering so as to provide the desired properties of the quality of paper. For example, over the course of several years, the standard newsprint has developed into several different quality categories, each of which requires a different mode of calendering of its own. Specific requirements have been imposed on the calender especially by these different quality categories, and it has not been possible to meet these requirements by means of earlier prior art calender arrangements. This factor has also contributed to making soft calenders with two nips more common. In such an arrangement, both nips of the calender are independent in such a calender with two nips so that the loads and the temperatures of rolls can be regulated as desired. Drawbacks of the soft calender with two nips have been the high cost of the arrangement and that a calender which consists of separate nips occupies a large amount of space in the machine direction.

Furthermore, environmental requirements have become stricter recently, which has had the consequence that paper is recycled to an ever greater extent by producing recycled stock out of reclaimed paper. The introduction of recycled stock and, further, the change over to ever thinner grammages in paper grades set their own strict requirements on the calender.

OBJECTS AND SUMMARY OF THE INVENTION

It is an object of the present invention to provide a calender of a novel type, which eliminates the above problems and which novel calender is suitable for calendering of several different types of paper.

In view of achieving this object, and others, the calender in accordance with the invention comprises a stack of rolls including at least three variable-crown rolls. Of these variable-crown rolls, the roll mantle of at least one roll is displaceable in relation to its roll axle in the direction of the nip plane by means of loading devices arranged inside this roll. The stack also includes at least one heatable roll arranged between two variable-crown rolls in the stack of rolls. Preferably, the stack includes only four rolls, three variable-crown rolls and a single heatable roll.

By means of the invention, it is possible to obtain a number of significant advantages in relation to the prior art, of which advantages the following will be mentioned. The calender in accordance with the invention can be varied from the basic concept to four different alternatives, so that the calender is highly versatile and is suitable for calendering several different paper grades. A calender in accordance with the invention with four rolls has three nips in the basic concept, but additionally it is also possible to operate the calender in accordance with the invention with two nips or even only one nip. The adjustability of the calender in accordance with the invention in relation to the linear loads in the nips is very beneficial so that, due to this adjustability, very large linear load ranges are controlled by means of the calender, whereby, by using one and the same calender, it is possible to calender several different paper grades. In the prior art, it has not been possible to obtain such a broad adjustability by means of one calender. Rather, different calenders have had to be constructed for calendering different types of paper.

other advantages and characteristic features of the invention will come out from the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
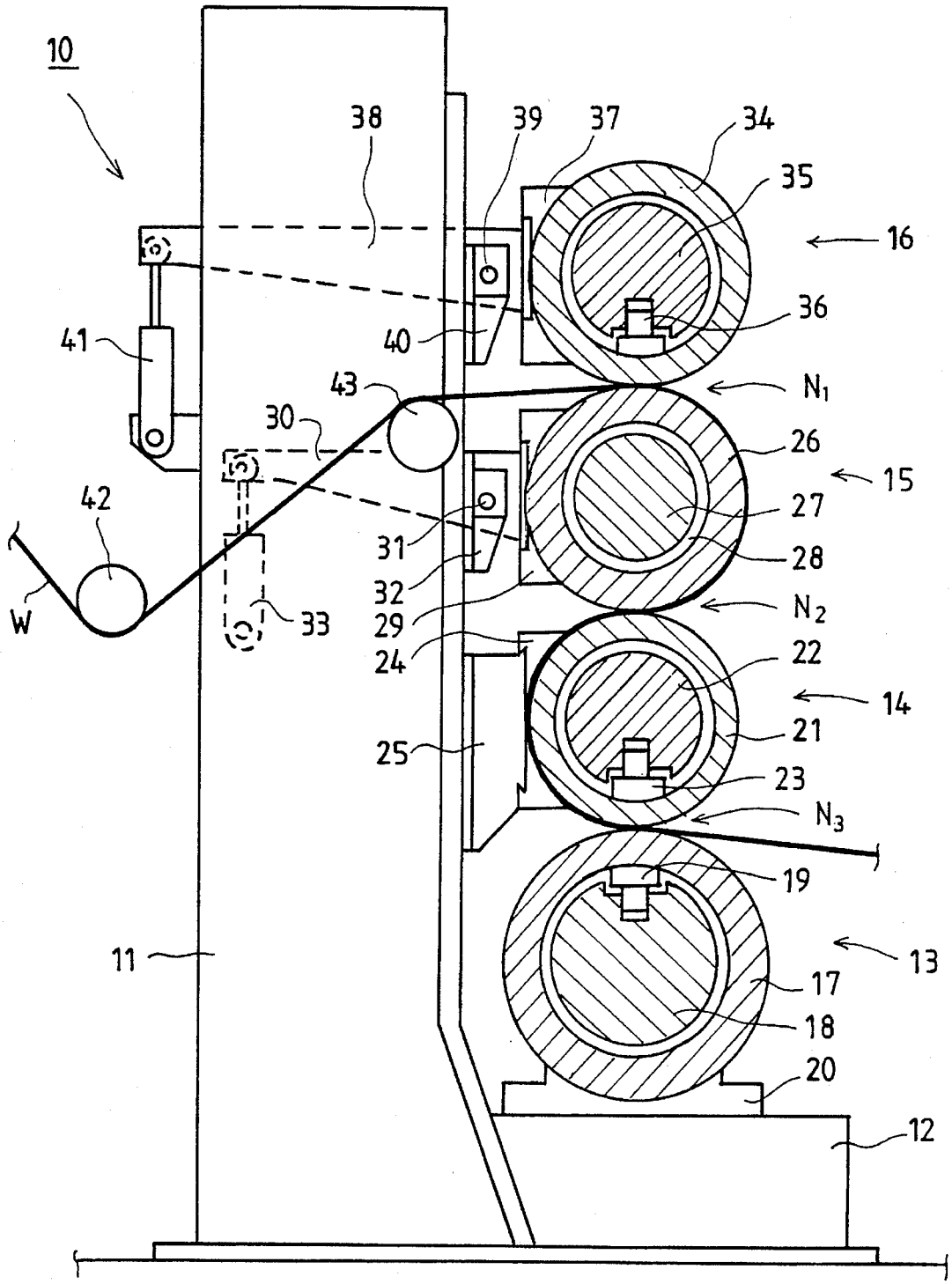
FIG. 1 is a fully schematic and partly sectional side view of a calender in accordance with the invention.

Referring to the drawings wherein like reference numerals refer to the same elements, in FIG. 1, the calender in accordance with the invention is denoted generally with the reference numeral 10. The calender 10 is a vertical calender with four rolls, comprising a calender frame 11,12 on which four rolls 13,14,15,16 of the calender are mounted as a stack of rolls so that the rolls form three calendering nips $N_1$,$N_2$, $N_3$ between them. A paper web W is arranged to run through the nips. Thus, the stack of rolls in the calender 10 consists of four rolls placed vertically one above the other, of which rolls, the lowest, i.e. the first roll 13, the second lowest roll 14, which forms a calendering nip $N_3$ with the first roll 13, and the highest or fourth roll 16 of the stack of rolls are variable-crown rolls, preferably rolls adjustable in zones. Of these variable-crown rolls, at least a roll mantle 17 of the lowest roll 13 can move radially in relation to an axle 18 of the roll 13 in the direction of the nip plane.

Preferably, all the variable-crown rolls 13,14,16 are constructed so that their respective roll mantles 17,21,34 are displaceable radially in relation to their respective roll axles 18,22,35 in the direction of the nip plane. The roll mantle 17,21,34 of these variable-crown rolls, especially the rolls adjustable in zones 13,14,16, is supported on their respective roll axles 18,22,35 by means of respective hydraulic loading devices 19,23,36. By means of these hydraulic loading devices, the roll mantle 17,21,34 of the rolls 13,14,16 are loaded in the direction of the nip plane in order to produce the desired linear loads in the calendering nips $N_1$,$N_2$,$N_3$. Such rolls adjustable in zones are known in themselves, and they have been described earlier, for example, in the assignee's Finnish Patent Nos. 79,177 and 79,178.

The third roll 15 in the stack of rolls, which forms calendering nips $N_1$ and $N_2$ with the second and the fourth roll 14,16 in the stack of rolls respectively, is a hard-faced, heatable roll, which, in the embodiment shown in the figures, comprises a roll mantle 26 revolvingly arranged on an axle 27 so that an intermediate space 28 remains between the axle 27 and the roll mantle 26. Into space 28, a heating medium for the heating of the roll 15 is passed. Such rolls are also in themselves known in the prior art. The heatable roll can also be different by its construction, for example, so that ducts passing substantially in the axial direction from one end to the other end of the roll are formed in the roll mantle 26, in which ducts the heating medium is arranged to circulate. The heating of the roll can also be arranged in other conventional ways.

The rolls 13,14,15,16 in the stack of rolls are mounted on the calender 10 as follows. The two lowest rolls in the stack of rolls, i.e. the first 13 and second roll 14, are mounted in stationary positions. Thus, bearing housings 20 of the first roll 13 are mounted directly on the calender frame 12. Bearing housings 24 of the second roll 14 are also fixedly mounted in relation to the calender frame 11, so that these bearing housings 24 are rigidly suspended on supports 25 mounted on the calender frame 11. The third roll 15 in the stack of rolls, i.e. the heatable roll, is mounted on the calender 10 by attaching bearing housings 29 of the third roll 15 to loading arms 30 which are pivotally mounted, by means of articulated joints 31 in the axial direction of the roll 15, on fastening brackets 32 arranged on the frame 11 of the calender. Loading cylinders 33 are attached to the opposite or free ends of the loading arms 30. By means of the loading cylinders 33, it is possible to pivot the loading arms 30 around the articulated joints 31. By means of this arrangement, it is possible to adjust the linear load in the second nip $N_2$ by means of the loading arms 30 and the loading cylinders 33, and further, it is possible to open the second nip $N_2$ by means of the loading arms 30 and the loading cylinders 33.

Similarly, the uppermost roll in the stack of rolls, i.e. the fourth roll 16, is mounted on the calender frame 11 by attaching bearing housings 37 of the fourth roll 16 to loading arms 38 which are pivotally mounted, by means of articulated joints 39 in the axial direction of the roll 16, on fastening brackets 40 attached to the calender frame 11. Loading cylinders 41 are arranged at the opposite or free ends of the loading arms 38. Loading cylinders 41 are also supported on the calender frame 11 from an opposite end. By means of the loading arms 38 and loading cylinders 41, it is possible to adjustably load the first nip $N_1$in the calender, and, additionally, it is possible to open the first nip $N_1$ by means of these devices.

In the basic construction of the calender 10 in accordance with the invention, the two lowest rolls in the stack of rolls, i.e. the first roll 13 and the second roll 14, are provided with drives, e.g., drive means. This is the case especially when all the rolls 13,14,15,16 of the calender 10 are hard-faced rolls.

In the calender, it is also possible to arrange a drive, i.e., appropriate drive means, on the uppermost roll in the stack of rolls, i.e. the fourth roll 16. It is thus possible to provide the fourth roll with a resilient coating. In such an embodiment, in which the fourth roll 16 is provided with a resilient coating, the threading of the web W into the middle nip, i.e. into the second nip $N_2$ of the calender, takes place while the first nip $N_1$ is open. The threading of the web into the second nip $N_2$ can be carried out, for example, either by means of an auxiliary nip formed by a small roll or by means of so-called "tail shooter" plates (these embodiments are not shown in FIG. 1). After the threading and widening of the web W, the fourth roll 16 is lowered into contact with the third roll 15, i.e. the first nip $N_1$ of the calender is closed.

In order to produce symmetrical paper by means of the calender 10, it is also possible to provide the lowest roll in the calender, i.e. the first roll 13, with a resilient coating. In such an embodiment, a so-called air doctor may be installed on the first roll 13, which air doctor is not in contact with the face of the roll 13. By means of the air doctor (not shown), it is possible to doctor the web W in its full width to the pulper (not shown). In this embodiment, also the lowest nip, i.e. the third nip $N_3$ of the calender, is open during the threading of the web W, and during the threading the lead-in strip is guided to the pulper by means of specifically directed fluid blows.

By means of the calender described above, in which both the uppermost roll 16 and the lowest roll 13 in the stack of rolls are provided with a resilient coating, it is possible to obtain the advantages that are essential in a soft calender. These obtainable advantages include better printing quality, high gloss, which is achieved by means of high temperatures, better strength qualities and better toughness and bulk and, further, better control of the quality of both sides of the paper. Compared to the soft calenders, the calender 10 in accordance with the invention has additionally a middle nip, i.e. the second nip $N_2$, which is a hard nip formed by the hard-faced rolls 14,15, and therefore it is possible to even the caliper by means of this hard nip $N_2$. Control of the caliper comparable to a hard-nip calender in accordance with the invention is not possible by means of a soft calender, so that the calender 10 in accordance with the invention can be considered superior to the soft calenders. If the raw paper is unequal-sided, i.e. if a separate press has not been used in the press section of the paper machine, it is possible to provide only the mantle of the upper roll, i.e. the fourth roll 16, of the calender 10 in accordance with the invention with a resilient coating.

Concerning a calender in accordance with FIG. 1, the loading cylinders 33,41 for loading the respective loading arms 30,38 of the third and the fourth roll 15,16 in the calender may be either hydraulic or pneumatic cylinders. By means of these loading arms 30,38 and loading cylinders 33,41, raising of the respective rolls 15,16 to the service position and raising of the rolls 16 or 15 and 16 into twin-nip operation or single-nip operation, which will be described in more detail later, are also facilitated. FIG. 1 shows the running of the web W into the calendering nips quite schematically and, by way of example, by means of guide and reversing rolls 42,43. Instead of these, alternative arrangements suitable for the purpose of running the web into the calendering nips can, of course, also be used.

Figure 2C:
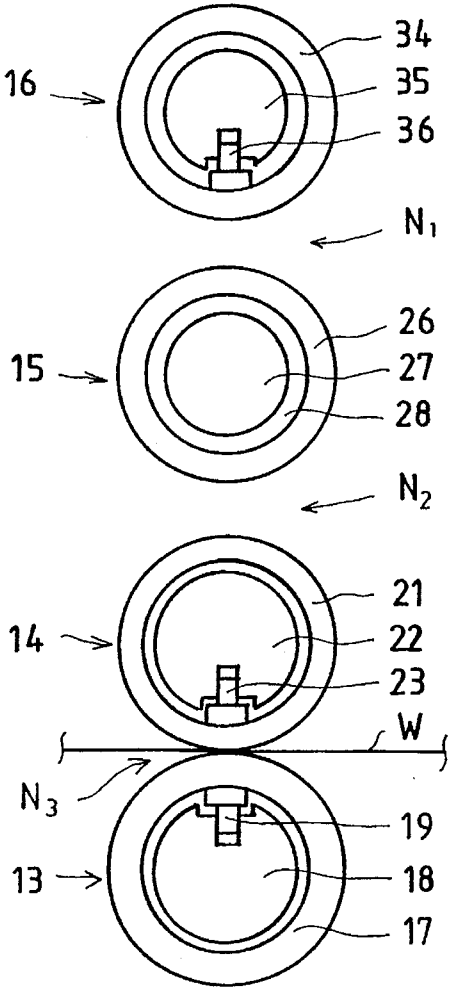
FIGS. 2A, 2B and 2C are schematic side views of the stack of rolls in a calender in accordance with the invention illustrating different running alternatives of the calender.
Figure 2B:
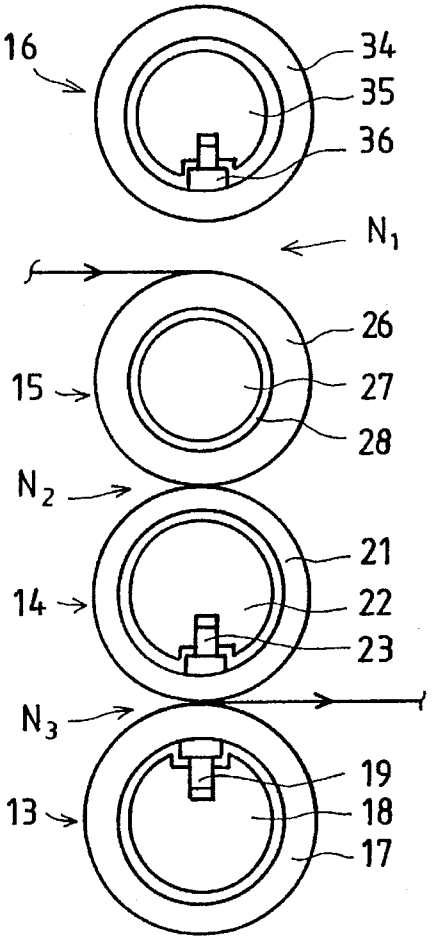
Figure 2A:
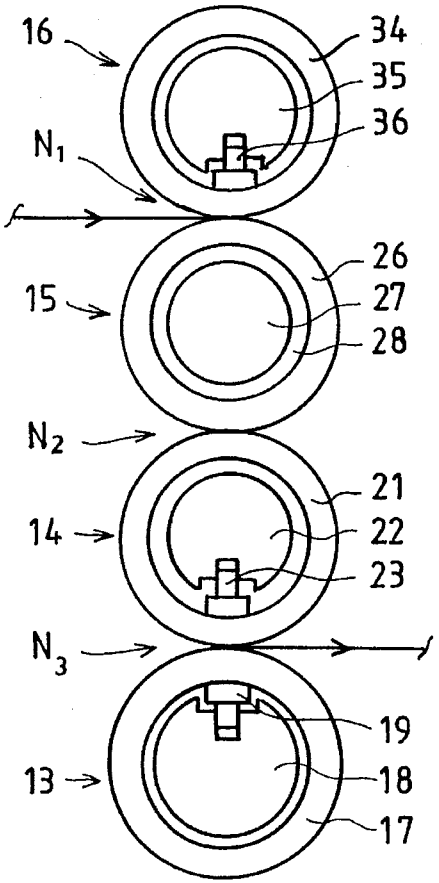

FIGS. 2A,2B and 2C as well as 3A,3B and 3C show alternative embodiments for different modes of operation of a calender 10 in accordance with the invention. In the following, these embodiments will be described fully by way of example in connection with the manner in which the invention provides a wide adjustability of the linear loads.

FIG. 2A shows the set of rolls of the calender 10 in accordance with the invention wherein the rolls 13,14,15,16 are arranged in a manner similar to FIG. 1, so that all the nips $N_1$,$N_2$,$N_3$ between the rolls are closed. Thus, in this embodiment, the calender 10 is operated with three nips. With such a mode of operation, it is possible to show by way of example that, in the adjustability of the linear loads in the nips $N_1$,$N_2$,$N_3$, the following values are reached, which are merely exemplifying numerical values illustrating the width of the ranges of adjustment.

If the calender concerned is relatively narrow, whose web width is of an order of about 7000 mm, the linear loads in the nips $N_1$,$N_2$,$N_3$ are adjustable within the following limits: the range of variation of the linear load in the first nip $N_1$ is from about 13 to about 91 kN/m, the range of variation of the linear load in the second nip $N_2$ is from about 30 to about 108 kN/m, and the range of variation of the linear load in the third nip $N_3$ is from about 52 to about 130 kN/m. If the calender 10 is constructed wide and the web width is, for example, about 9300 mm, the ranges of variation of linear loads in the nips $N_1$,$N_2$,$N_3$ are as follows: the first nip $N_1$ is from about 25 to about 85 kN/m, the second nip $N_2$ is from about 45 to about 105 kN/m, and the third nip $N_3$ is from about 70 to about 130 kN/m.

FIG. 2B shows an operative embodiment of running the calender 10 with two nips. The uppermost or topmost roll in the calender stack, i.e. the fourth roll 16, has been raised or elevated by means of the loading arms 38 and the loading cylinder 41, so that the first nip $N_1$ is open. Thus, in this embodiment, the fourth roll 16 does not affect the paper web W in any way, but the web is passed over the third roll 15 only through the second nip $N_2$ and the third nip $N_3$ in the calender. The linear loads in the nips $N_2$and $N_3$ are adjustable in the following manner. The linear load in the narrow calender described above, in the nip $N_2$ between the second and the third roll 14,15, is of an order of about 17 kN/m, and it is adjustable between about 39 to about 130 kN/m in the nip $N_3$ between the first and the second roll 13,14. Correspondingly, the wide calender described above has a nip load of an order of about 20 kN/m in the nip $N_2$ between the second roll 14 and the third roll 15, and an adjustable nip load between about 45 to about 130 kN/m in the nip $N_3$ between the first roll 13 and the second roll 14.

FIG. 2C shows an operative embodiment of running the calender 10 with one nip. In addition to the opening of nip $N_1$ in the embodiment shown in FIG. 2B, the third roll 15 in the stack of rolls has also been raised by means of the loading arms 30 and the loading cylinders 33 so that both the first nip $N_1$ and the second nip $N_2$ in the stack of rolls are open. In this embodiment, the paper web W is passed only through the nip $N_3$ between the first roll 13 and the second roll 14. In nip $N_3$, similarly to the embodiments described above, the linear loads are adjustable in a narrow calender construction between about 15 to about 110 kN/m, and it is also possible to reach the same adjustability, i.e. from about 15 to about 110 kN/m, by means of a wide calender construction. Compared to the embodiment illustrated in FIG. 2A, the lowering of the lower limit of the adjustment ranges in the embodiments of FIGS. 2B and 2C is naturally derived from the fact that, in FIGS. 2B and 2C, the weights and/or loadings of the upper rolls do not affect, or add to, the loading pressures in the nips between the lower rolls.

Figure 3C:
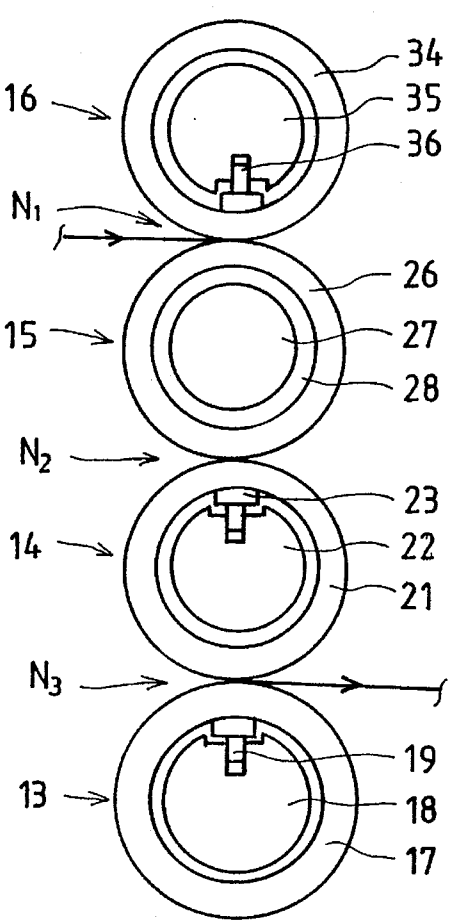
FIGS. 3A, 3B and 3C are views, corresponding to FIGS. 2A, 2B and 2C, of the stack of rolls in a calender in accordance with the invention illustrating especially the possibility of controlling large ranges of linear load by means of the calender in accordance with the invention.
Figure 3B:
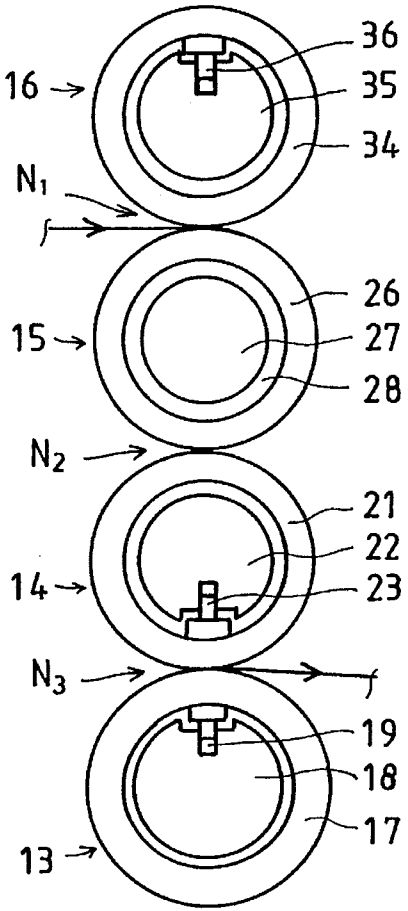
Figure 3A:
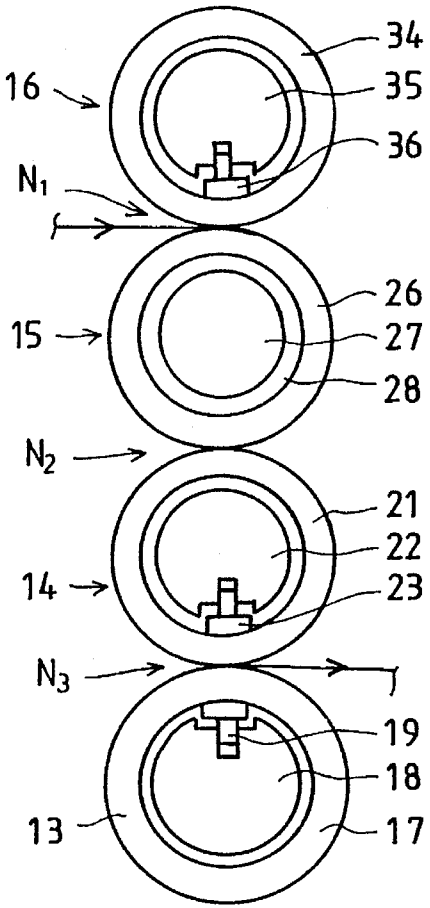

Further embodiments for the adjustability of the linear loads in the nips $N_1$,$N_2$,$N_3$ in the calender 10 in accordance with the invention are shown in FIGS. 3A, 3B and 3C. The situation in accordance with FIG. 3A corresponds to the basic construction presented in FIGS. 1 and 2A, so that, in the case of FIG. 3A, the linear loads in the nips $N_1$,$N_2$,$N_3$ are adjustable in a similar manner to that described in relation to FIG. 2A.

The embodiment of FIG. 3B is essentially different from the embodiments described above. In this embodiment, the axle 35 of the uppermost roll in the stack of rolls, i.e. the fourth roll 16, is mounted in the bearing housings 37 so that it is possible to rotate the axle 35 through 180 degrees in relation to the center axis of the roll 16. FIG. 3B shows precisely a situation in which the rotating of the axle 35 of the roll 16 has taken place, whereby the hydraulic loading devices 36 in the fourth roll 16 are still in the nip plane of the stack of rolls, but they no longer load the first nip $N_1$. Rather, the hydraulic loading devices 36 act in the opposite direction away from the nip $N_1$.

By means of the arrangement shown in FIG. 3B, it is possible to achieve the following linear load levels in the nips $N_1$,$N_2$,$N_3$, with reference to the examples illustrated in FIGS. 2A,2B,2C. In the first nip $N_1$, the linear loads are of an order of about 15 kN/m in a narrow and in a wide calender construction. Correspondingly, in the second nip $N_2$, it is possible to achieve a linear load of an order of about 32 kN/m with a narrow calender construction and of an order of about 35 kN/m with a wide calender construction. Similarly, the linear load range in the nip $N_3$ between the first roll 13 and the second roll 14 in the stack of rolls is, with a narrow calender construction of an order of from about 54 to about 130 kN/m and, with a wide calender construction, from about 60 to about 130 kN/m.

The embodiment in accordance with FIG. 3C differs from those described above in the respect that, in the calender in accordance with this embodiment, the axle 22 of the second roll 14 in the stack of rolls is mounted in the bearing housings 24 so that it is possible to rotate the axle 22 through 180 degrees in relation to the center axis of the roll 14, around which the roll axle revolves. In the illustrated embodiment in FIG. 3C, the rotation of the axle 22 of the roll has taken place, after which, differing from FIG. 3A, the hydraulic loading devices 23 of the roll 14 do not load the nip $N_3$ between the first roll 13 and the second roll 14 in the stack of rolls. Rather, the hydraulic loading devices 23 load the nip $N_2$ between the second roll 14 and the third roll 15. Differing from the embodiment of FIG. 3B, in the embodiment of FIG. 3C, the hydraulic loading elements 36 of the topmost roll in the stack, i.e. the fourth roll 16, load the nip $N_1$ between the third roll 15 and the fourth roll 16.

According to the exemplifying embodiment described above, it is possible to reach the following linear load levels by means of the embodiment in accordance with FIG. 3C. In the nip $N_1$ between the fourth roll 16 and the third roll 15, the linear load levels will be, in a narrow calender construction, in the range of from about 13 to about 97 kN/m and, in a wide calender construction, between about 25 to about 85 kN/m. In the nip $N_2$ between the third roll 15 and second roll 14, the linear load levels are correspondingly, in a narrow calender construction, in the range of from about 30 to about 114 kN/m and, in a wide calender construction, from about 45 to about 110 kN/m. In the nip $N_3$ between the second roll 14 and the first roll 13, the linear loads are again, in both narrow and wide calender constructions of an order of from about 15 to about 130 kN/m.

The alternative possibility discussed above, i.e., to rotate the axles 22,35 of the second roll 14 and the fourth roll 16, results in a remarkable improvement in the adjustability of the linear loads in the nips $N_1$,$N_2$,$N_3$. It is possible to carry out the rotation of the axles 22,35 of the rolls 14,16 manually, or the axles of the rolls can be provided with a suitable drive gear, such as a motor or equivalent, by means of which it is possible to carry out the rotation of the axles. Further referring to the description above, the given linear load levels are merely examples, illustrating how a wide adjustability of the linear loads is achieved by means of a calender in accordance with the invention. However, it should be noted that the given numerical values are related to certain calender constructions only, so that the adjustability of the linear loads of a calender in accordance with the invention is by no means restricted to these numerical values. By means of other calender constructions, it is possible to produce linear load ranges which differ from the given values considerably.

By means of a calender in accordance with the invention, it is possible to achieve substantially all the advantages that it is possible to achieve by means of conventional soft calenders, as was already stated earlier. In relation to soft calenders, a further advantage is obtained by means of the calender in accordance with the invention, in that the middle nip $N_2$ is a hard nip which evens out the caliper. It is not possible to achieve corresponding evening out of the caliper by means of conventional prior art soft calenders. It has also been stated in the description above that, in the basic embodiment of the invention, the two lowest rolls 13,14 in the stack of rolls in the calender 10 are driven rolls. However, it is understood that the topmost roll 16 in the stack of rolls can also be provided with a drive gear.

It is understood that while the illustrated embodiment shows four rolls which, upon selective engagement of a roll of an adjacent pair of rolls to the other roll of the pair, enable either a three-nip calender, a two-nip calender or a one-nip calender, the teachings of the invention can be also be applied to calenders having more than four rolls which would enable more than three nips to be formed. In addition, although in the preferred embodiment the lowest two rolls and the uppermost roll of a stack of four rolls are variable-crown rolls, other possible constructions and arrangements of the three variable-crown rolls and one heatable roll are possible.

The examples provided above are not meant to be exclusive. Many other variations of the present invention would be obvious to those skilled in the art, and are contemplated to be within the scope of the appended claims.

We claim:

1. A calender for calendering a web, comprising a calender frame, a plurality of rolls stacked one above the other and mounted on said calender frame, said stack of rolls comprising at least four rolls each having a roll axle and situated such that the rolls of each pair of adjacent rolls are arrangeable in nip-defining relationship with each other to calender the web in said nip, said stack of rolls defining successively arranged first, second, third and fourth rolls whereby said first roll is the lowest roll of said at least four rolls in said stack of rolls, said at least four rolls comprising three variable-crown rolls and a heatable roll arranged between two of said three variable-crown rolls, said first roll said second roll and said fourth roll constituting said three variable-crown rolls and said third roll constituting said heatable roll, at least one of said three variable-crown rolls comprising a roll mantle rotatable around said roll axle and loading means arranged in said roll mantle for displacing said roll mantle relative to said roll axle in a direction of a plane containing a central axis of said roll axle and the nip defined in part by said at least one of said three variable-crown rolls, means for fixedly mounting said axles of said first and second rolls on said calender frame to substantially prevent movement of said first and second rolls in a direction of a plane containing a respective central axis of said axles of said first and second rolls and the respective nip or nips defined in part by said first and second rolls, and means for adjustably mounting said axles of said third and fourth rolls on said calender frame such that said axles of said third and fourth rolls are displaceable in a direction of a plane containing a respective central axis of said axles of said third and fourth rolls and the respective nip or nips defined in part by said third and fourth rolls.

2. The calender of claim 1, wherein said first roll constitutes said at least one of said three variable-crown rolls in which said loading means are arranged.

3. The calender of claim 1, wherein said at least one of said three variable-crown rolls comprises all three of said three variable-crown rolls, each of said variable crown-rolls comprising a roll mantle rotatable around said roll axle and loading means arranged in said roll mantle for displacing said roll mantle relative to said roll axle in a direction of a plane containing a central axis of said roll axle and the nip defined in part by each of said three variable-crown rolls.

4. The calender of claim 1, wherein said variable-crown rolls comprise adjustable pressure zones therein.

5. The calender of claim 1, wherein said means for adjustably mounted said axles of said third and fourth rolls on said calender fame comprise loading arms and loading cylinders.

6. The calender of claim 1, wherein said fourth roll is displaceable away from said third roll via said means for adjustably mounting said fourth roll to thereby open the nip defined between said fourth roll and said third roll, such that the web is passed only through the nip defined between said third roll and said second roll and through the nip defined between said second and said first roll to form a two-nip calender.

7. The calender of claim 1, wherein said fourth roll is displaceable away from said third roll and said third roll is displaceable from said second roll via said means for adjustably mounting said third and fourth rolls to thereby open the nip defined between said fourth roll and said third roll and the nip defined between said third roll and said second roll, such that the web is passed only through the nip defined between said second roll and said first roll to form a one-nip calender.

8. The calender of claim 1, further comprising drive means coupled to at least said first and second rolls in said stack of rolls for driving a respective one of said first and second rolls.

9. The calender of claim 8, further comprising additional drive means coupled to said fourth roll for driving said fourth roll.

10. The calender of claim 9, further comprising a resilient roll coating situated on said fourth roll.

11. The calender of claim 10, further comprising a resilient roll coating situated on said first roll.

12. The calender of claim 1, wherein said at least four rolls in said stack of rolls are hard rolls.

13. The calender of claim 1, wherein at least one of said variable-crown rolls is a heated roll.

14. A calender for calendering a web, comprising a calender frame, a plurality of rolls stacked one above the other and mounted on said calender frame, said stack of rolls comprising at least four rolls each having a roll axle and situated such that the rolls of each pair of adjacent rolls are arrangeable in nip-defining relationship with each other to calender the web in said nip, said stack of rolls defining successively arranged first, second, third and fourth rolls whereby said first roll is the lowest roll of said at least four rolls in said stack of rolls, said at least four rolls comprising three variable-crown rolls and a heatable roll arranged between two of said three variable-crown rolls, said fourth roll constituting one of said three variable-crown rolls and comprising a roll mantle rotatable around said roll axle and loading means arranged in said roll mantle for displacing said roll mantle relative to said roll axle in a direction of a plane containing a central axis of said roll axle and the nip defined in part by said fourth roll, said loading means comprising loading devices connected to said axle of said fourth roll to load said fourth roll in said nip plane containing said central axis of said roll axle of said fourth roll, and means coupled to said fourth roll for rotatably mounting said axle of said fourth roll to said calender frame such that said axle of said fourth roll is rotatable through 180° about said central axis of said roll axle of fourth roll such that adjustability of the level of linear loads in the nips is extended and said loading devices in said fourth roll are rotatable away from a direction of loading of the nip between said fourth roll and said third roll.

15. The calender of claim 14, further comprising rotation means for rotating said axle of said fourth roll, said rotation means comprising a motor.

16. A calender for calendering a web, comprising a calender frame, a plurality of rolls stacked one above the other and mounted on said calender frame, said stack of rolls comprising at least four rolls each having a roll axle and situated such that the rolls of each pair of adjacent rolls are arrangeable in nip-defining relationship with each other to calender the web in said nip, said at least four rolls comprising three variable-crown rolls and a heatable roll arranged between two of said three variable-crown rolls, said stack of rolls defining successively arranged first, second, third and fourth rolls whereby said first roll is the lowest roll of said at least four rolls in said stack of rolls, said second roll constituting one of said three variable-crown rolls and comprising a roll mantle rotatable around said roll axle and loading means arranged in said roll mantle for displacing said roll mantle relative to said roll axle in a direction of a plane containing a central axis of said roll axle and the nip defined in part by said second roll, said loading means comprising loading devices connected to said axle of said second roll to load said second roll in said nip plane containing said central axis of said axle of said second roll, and means coupled to said second roll for rotatably mounting said axle of said second roll to said calender frame such that said axle of said second roll is rotatable through 180° about said central axis of said roll axle of said second roll such that adjustability of the level of linear loads in the nips is extended and said loading devices in said second roll are rotatable between a position in which said loading devices load the nip between said second roll and said third roll and a position in which said loading devices load the nip between said first roll and said second roll.

17. The calender of claim 16, further comprising rotation means for rotating said axle of said second roll, said rotation means comprising a motor.

* * * * *